US008131181B2

(12) United States Patent
Hoashi

(10) Patent No.: US 8,131,181 B2
(45) Date of Patent: Mar. 6, 2012

(54) IMAGE FORMING APPARATUS

(75) Inventor: Shigeru Hoashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 12/582,145

(22) Filed: Oct. 20, 2009

(65) Prior Publication Data

US 2010/0098459 A1 Apr. 22, 2010

(30) Foreign Application Priority Data

Oct. 22, 2008 (JP) ..... 2008-271782
Sep. 16, 2009 (JP) ..... 2009-214303

(51) Int. Cl.
*G03G 15/00* (2006.01)

(52) U.S. Cl. ..... 399/110; 399/111

(58) Field of Classification Search ..... 399/107, 399/108, 110–114, 125
See application file for complete search history.

(56) References Cited

U.S. PATENT DOCUMENTS 6,714,752 B2 3/2004 Ueno et al. ..... 399/117
(Continued)

*Primary Examiner* — Hoan Tran
(74) *Attorney, Agent, or Firm* — Fitzpatrick, Cella, Harper & Scinto

(57) ABSTRACT

An image forming apparatus for forming an image on a recording material includes an opening provided to a main assembly of the apparatus, a first openable member, a second openable member, and a movable member. The movable member is movable between a set position inside the main assembly and an outward position. The first openable member can be located at an open position below the movable member located at the outward position. An outermost end of the movable member can be located at the outward position so as to be vertically aligned with or located inside an outermost end of the first openable member located at the open position.

8 Claims, 13 Drawing Sheets

U.S. PATENT DOCUMENTS

| | | | | |
|---|---|---|---|---|
| 6,829,455 | B2 | 12/2004 | Yasumoto et al. | 399/167 |
| 6,898,391 | B2 | 5/2005 | Numagami et al. | 399/90 |
| 7,092,658 | B2 | 8/2006 | Yasumoto et al. | 399/167 |
| 7,209,682 | B2 | 4/2007 | Numagami et al. | 399/167 |
| 7,246,963 | B2 * | 7/2007 | Nishimura | 400/692 |
| 7,433,622 | B2 * | 10/2008 | Chadani et al. | 399/90 |
| 7,440,715 | B2 | 10/2008 | Numagami et al. | 399/167 |
| 7,486,907 | B2 * | 2/2009 | Noguchi et al. | 399/110 |
| 7,509,071 | B2 * | 3/2009 | Yoshimura et al. | 399/111 |
| 7,570,900 | B2 | 8/2009 | Chadani et al. | 399/111 |
| 2007/0160380 | A1 | 7/2007 | Imaizumi et al. | 399/90 |

* cited by examiner

IMAGE FORMING APPARATUS

FIELD OF THE INVENTION AND RELATED ART

The present invention relates to an image forming apparatus, to which a cartridge is detachably mountable, for forming an image on a recording material (medium).

The image forming apparatus includes, e.g., those of an electrophotographic type, an electrostatic recording type, a magnetic recording type, and the like, such as a copying machine, a printer (a laser beam printer, an LED printer, or the like), a facsimile machine, a word processor, and the like.

The cartridge includes at least one of an image bearing member on which a latent image is to be formed and a developing means for developing the latent image formed on the image bearing member with a developer and is detachably mountable to an apparatus main assembly. The apparatus main assembly is a portion of the image forming apparatus except the cartridge and a movable member for moving the cartridge. The cartridge is mountable to and demountable from the apparatus main assembly by a user himself (herself). For that reason, maintenance of the apparatus main assembly can be easily performed.

The image bearing member is a member on which the latent image (such as an electrostatic latent image, a potential latent image, a resistance latent image, or a magnetic latent image) is to be developed with the developer is formed. Examples of the image bearing member may include an electrophotographic photosensitive member (photoconductor) in an electrophotographic process, an electrostatic recording dielectric member in an electrostatic recording process, and a magnetic recording magnetic member in a magnetic recording process.

U.S. Patent Application Publication No. 2007/160380 discloses a constitution of a color electrophotographic image forming apparatus in which a plurality of process cartridges is supported by a movable member movable with respect to the apparatus main assembly. According to this constitution, the plurality of process cartridges can be inserted simultaneously into the apparatus main assembly. Further, the movable member is pulled out from the apparatus main assembly and then a desired cartridge can be demounted from the member and can be replaced with a fresh cartridge.

SUMMARY OF THE INVENTION

The present invention have further developed the above-described conventional constitutions.

A principal object of the present invention is provide an image forming apparatus which has realized that a plurality of cartridges is inserted into an apparatus main assembly in a state in which the cartridges are supported by a movable member.

Another object of the present invention is to provide an image forming apparatus in which a disposing area during the insertion of the plurality of cartridges into the apparatus main assembly is reduced, thereby to improve a space-saving property.

A further object of the present invention is to provide an image forming apparatus capable of protecting the plurality of cartridges when the cartridges are inserted into the apparatus main assembly.

According to an aspect of the present invention, there is provided an image forming apparatus for forming an image on a recording material, comprising:

an opening provided to a main assembly of the image forming apparatus;

a first openable member movable between a closed position in which a first portion of the opening is closed and an open position in which the first portion of the opening is opened;

a second openable member movable between a closed position in which a second portion of the opening is closed and an open position in which the second portion of the opening is opened; and a movable member, movable between a set position inside the main assembly and an outward position in which the movable member having passed through the first portion of the opening is located at an outermost position in a movable range of the movable member, capable of supporting a plurality of cartridges, side by side, each including at least one of an image bearing member on which a latent image is to be formed and developing means for developing with a developer the latent image formed on the image bearing member;

wherein the first openable member located at the open position is located below the movable member located at the outward position, and wherein an outermost end of the movable member located at the outward position is vertically aligned with or located inside an outermost end of the first openable member located at the open position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(General Structure of Image Forming Apparatus)

Figure 1A:
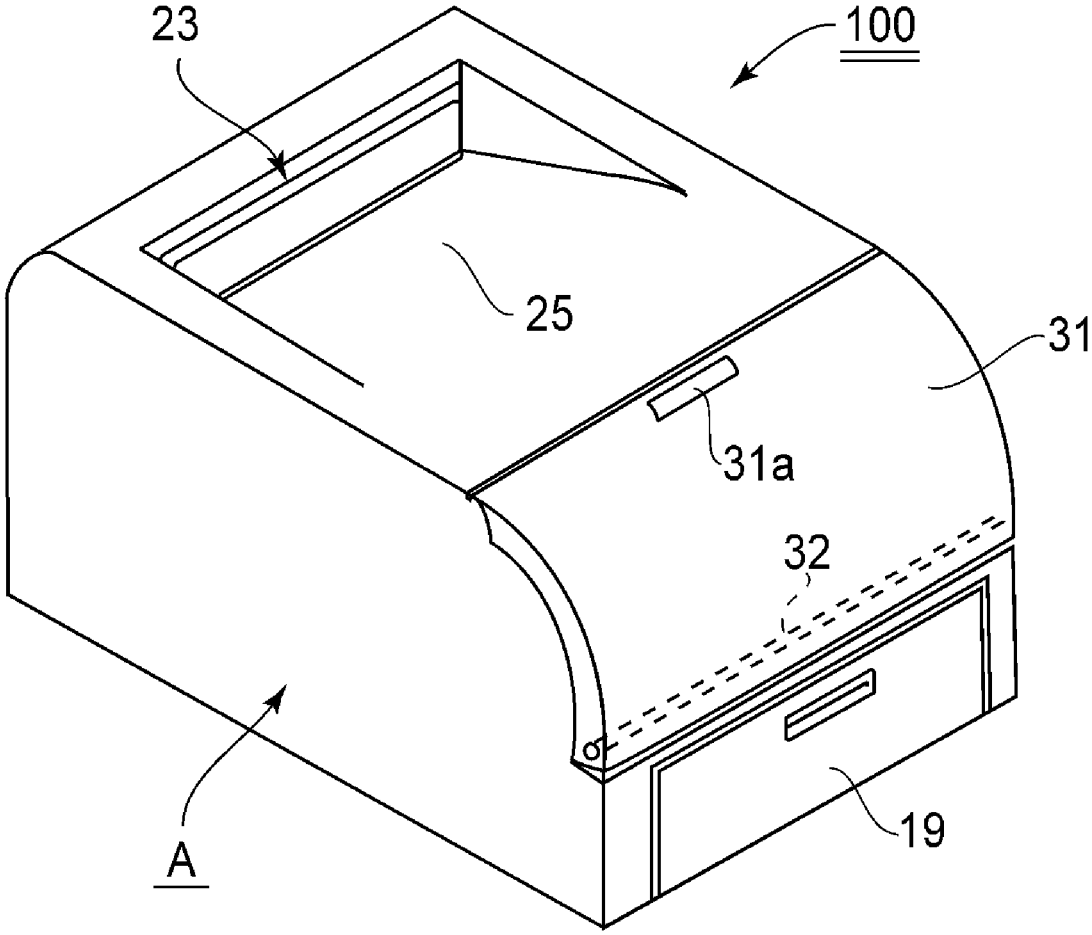
FIG. 1A is a perspective view of an outer appearance of an image forming apparatus in Embodiment 1 in a state in which an openable door is closed.
Figure 1B:
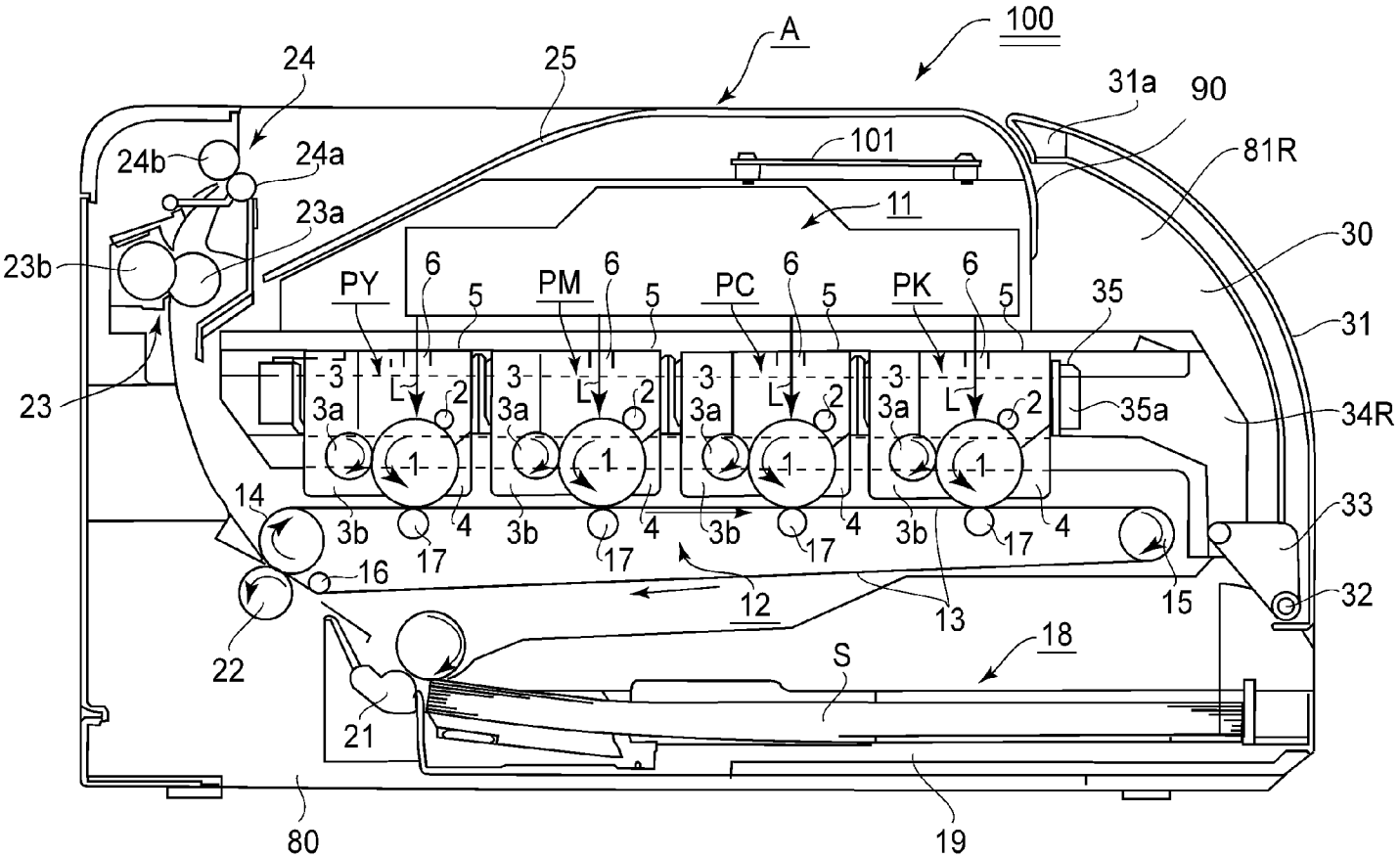
FIG. 1B is a longitudinal left side view of the image forming apparatus.

FIG. 1A is a perspective view of an outer appearance of a color electrophotographic image forming apparatus 100 in this embodiment, and FIG. 1B is a longitudinal left side sectional view of the image forming apparatus 100. The image forming apparatus 100 is a four color-based full-color electrophotographic laser printer using an electrophotographic process. That is, the image forming apparatus 100 (printer) forms an image on a recording material (a sheet, an OHP sheet, a label, etc.) S on the basis of an electrical image signal input from an external host device (not shown) such as a personal computer, an image reader, or a remote facsimile machine.

In the following description, a front side (front surface side) of the image forming apparatus 100 means the side on which a door 31 as an openable member with respect to an opening 30 of an apparatus main assembly A is provided. A rear side of the image forming apparatus 100 is the side opposite to the front side. A front-rear direction includes a frontward direction toward front as seen from the rear side of the apparatus main assembly A and a rearward direction opposite to the frontward direction. The left and right sides means the left and right sides as seen from the front side of the apparatus main assembly A. A left-right direction includes a leftward direction toward left as seen from the front side and a rightward direction opposite to the leftward direction.

In an apparatus main assembly 100A of the image forming apparatus 100, four (first to fourth) process cartridges PY, PM, PC and PK are horizontally arranged side by side in this order in terms of the rear-to-front direction (inline or tandem arrangement). The four process cartridges have the same constitution except that colors of developers (toners) accommodated therein are different from each other. Each cartridge in this embodiment includes an electrophotographic photosensitive drum 1 as an image bearing member on which a latent image is to be formed, and further includes a charging means 2, developing means 3, and a cleaning means 4 which are used as image forming process means acting on the drum 1. Further, each cartridge is prepared by integrally mounting the above-described drum 1, the charging means 2, the developing means 3, and the cleaning means 4 in a cartridge frame 5. The charging means 2 in this embodiment is a charging roller. The developing means 3 includes a developing roller 3*a* and a developer container 3*b* in which the developer (toner) is accommodated. The cleaning means 4 is of a blade type.

The container 3*b* of the first cartridge PY stores yellow (Y) toner. On the surface of the drum 1, a developer image of yellow (Y) is formed. The developing device 3 of the second cartridge PM stores magenta (M) toner. On the surface of the drum 1, a developer image of magenta (M) is formed. The developing device 3 of the third cartridge PC stores cyan (C) toner. On the surface of the drum 1, a developer image of cyan (C) is formed. The developing device 3 of the fourth cartridge PK stores black (K) toner. On the surface of the drum 1, a developer image of black (K) is formed.

Above the first to fourth cartridges PY, PM, PC, and PK, a laser scanner unit 11 is disposed. This scanner unit 11 outputs laser light L modulated correspondingly to image (picture) information for each color input from the external host device. The output laser light L enters each cartridge through an exposure window 6 provided at an upper surface of the cartridge frame 5. Thus, laser scanning exposure is performed on the surface of the drum 1. The laser scanner unit 11 is protected by a vertical wall portion 90 provided close to an upper portion of the door (openable member) 31 at a closed position of the door 31.

An intermediary transfer belt unit 12 is disposed below the cartridges PY, PM, PC, and PK. The belt unit 12 includes an endless belt 13 having flexibility, a driving roller 14, a turn roller 15, and a tension roller 16 around which the belt 13 is stretched and circulatively moved. The driving roller 14 and tension roller 16 are disposed on the rear side of the apparatus main assembly A. The turn roller 15 and is disposed on the front side of the apparatus main assembly A. A lower surface of the drum 1 of each cartridge contacts an upper surface of an upper belt portion of the belt 13. Inside the belt 13, four primary transfer rollers 17 are disposed. Each primary transfer roller 17 is disposed opposite to the drum 1 of the corresponding cartridge through the upper belt portion of the belt 13. A secondary transfer roller 2 contacts the belt 13 and opposes the driving roller 14 through the belt 13.

Below the belt unit 12, a (sheet) feeding unit 18 is disposed, which includes a (sheet) feeding tray 19, a (sheet) feeding roller 20, and a separation pad 21, and the like. The tray 20 is detachably mountable in the apparatus main assembly A from the front side of the apparatus main assembly A (front loading).

At an upper portion on the rear side of the apparatus main assembly A, a fixing device 23 and a (sheet) discharging roller pair 24 are disposed. Further, at an upper surface of the apparatus main assembly A, a (sheet) discharging tray 25 is provided. The fixing device 23 includes a fixation film assembly 23*a* and a pressing roller 23*b*. The discharging roller pair 24 includes rollers 24*a* and 24*b*.

Each cartridge P placed in a state in which it is set at a set position in the apparatus main assembly A is urged by an urging member (not shown) to be held in a state in which each cartridge is fixed to a predetermined positioning portion. To a drive input portion (not shown) of each cartridge, a driving output portion (not shown) of the apparatus main assembly A is connected. Further, to an electrical contact (not shown) of each cartridge, an electric energy supplying system (not shown) of the apparatus main assembly A is electrically connected.

An operation for forming a full-color image is as follows. The drum 1 of each of the first to fourth cartridges PY, PM, PC and PK is rotationally driven at a predetermined control speed in the counterclockwise direction indicated by the arrow. Further, the belt 13 is rotationally driven in the clockwise direction indicated by an arrow (the (normal) rotational direction of the drum 1) at a speed which corresponds to the speed of the drum 1. The scanner unit 11 is also driven. In synchronization with the driving of the scanner unit 11, the charging roller 2 in each cartridge uniformly electrically charges the surface of the drum 1 to predetermined polarity and potential with predetermined control timing. The scanner unit 11 scans (exposes) the surface of each drum 1 with the laser light L modulated correspondingly to the image signal for an associated color. As a result, an electrostatic latent image corresponding to the image signal for the associated color is formed on the surface of the drum 1. The thus formed electrostatic latent image is developed by the developing roller 3*a* into a developer image.

Through the above described electrophotographic image forming process operation, a yellow developer image, which corresponds to the yellow (Y) color component of a full-color image is formed on the drum 1 of the first cartridge PY. The developer image is primary-transferred onto the belt 13. On the drum 1 of the second cartridge PM, a magenta (M) developer image, which corresponds to the magenta component of the full-color image is formed. The developer image is primary-transferred onto the Y developer image, which has been transferred on the belt 13, in a superposition manner. On the drum 1 of the third cartridge PC, a cyan (C) developer image, which corresponds to the cyan component of the full-color image is formed. The developer image is primary-transferred onto the Y and M developer images, which have been transferred on the belt 13, in the superposition manner. On the drum 1 of the fourth cartridge PK, a black (K) developer image, which corresponds to the black component of the full-color image is formed. The developer image is primary-transferred onto the Y, M and C developer images, which have been transferred on the belt 13, in the superposition manner. Thus, an unfixed full-color developer image based on the four colors of Y, M, C and K is synthetically formed on the belt 13. In each cartridge, an untransferred developer remaining on the surface of the drum 1 after the primary transfer of the developer images on the belt 13 is removed by the cleaning means 4.

Meanwhile, the feeding roller 20 is driven with predetermined control timing. As a result, sheets S (recording material) stacked on the tray 19 are separated and fed one by one by cooperation of the roller 20 and the separation pad 21 to be introduced into a nip (secondary transfer nip) between the secondary transfer roller 22 and the belt 13. As a result, onto the surface of the sheet S, the superposed four color developer images are collectively from the belt 13 onto the surface of the sheet S during nip-conveyance of the sheet S in the nip.

The sheet S is separated from the surface of the belt 13 and is then guided into the fixing device 23 to be subjected to heat and pressure in a fixation nip of the fixing device 23. As a result, color mixing of the respective color developer images and fixation thereof on the sheet S are performed. Thereafter, the sheet S is moved out of the fixing device 23, and then is discharged as a full-color image formation product onto the sheet discharge tray 25 by the discharge roller pair 24. In this embodiment, a secondary transfer residual developer remaining on the surface of the belt 13 after the sheet separation is, e.g., at the primary transfer portion of the first process cartridge PY, electrostatically deposited on the surface of the drum 1 and then is removed by the cleaning means 4.

(Cartridge Exchange)

As each of the first to fourth cartridges PY, PM, PC and PK is used for image formation, the developer (toner) stored in the developing means 3 is consumed. For this reason, e.g., the image forming apparatus is provided with a means (not shown) for detecting an amount of the developer remaining in each cartridge. The detected amount of the developer in each cartridge is compared, by a control circuit portion 101, with a threshold value preset for providing a prewarning or warning of the lifetime of the cartridge. When the detected amount of the residual developer in the cartridge is smaller than the preset threshold value, the prewarning or warning of the lifetime of the cartridge is displayed on a display portion (not shown). As a result, the image forming apparatus prompts the user to prepare a cartridge for exchange, or to replace the cartridge with a fresh cartridge, in order to maintain an output image quality.

In this embodiment, the exchange (replacement) of the cartridge with respect to the image forming apparatus is performed through a method in which the cartridge (PY, PM, PC or PK) is placed on a cartridge tray 35 as a frame-like movable member and is replaced in a front-access manner in order to improve usability.

At the time when the cartridge tray 35 is pulled out from the apparatus main assembly A to an outermost position in a movable range of the tray 35, i.e., at an outward position in which the tray 35 is located at the outermost position, all the cartridges PY, PM, PC and PK are located outside the apparatus main assembly A. Therefore, the cartridge exchanging operation with respect to the tray 35 can be facilitated.

This will be described more specifically.

On the front side of the apparatus main assembly A, an opening 30 for permitting passing of the cartridges therethrough is provided in order to insert the cartridges into the apparatus main assembly A and demount the cartridges from the apparatus main assembly A.

The door 31 is as openable member movable between a closed position in which the opening 30 is covered with the door 31 and an open position in which the opening 30 is exposed.

Figure 2A:
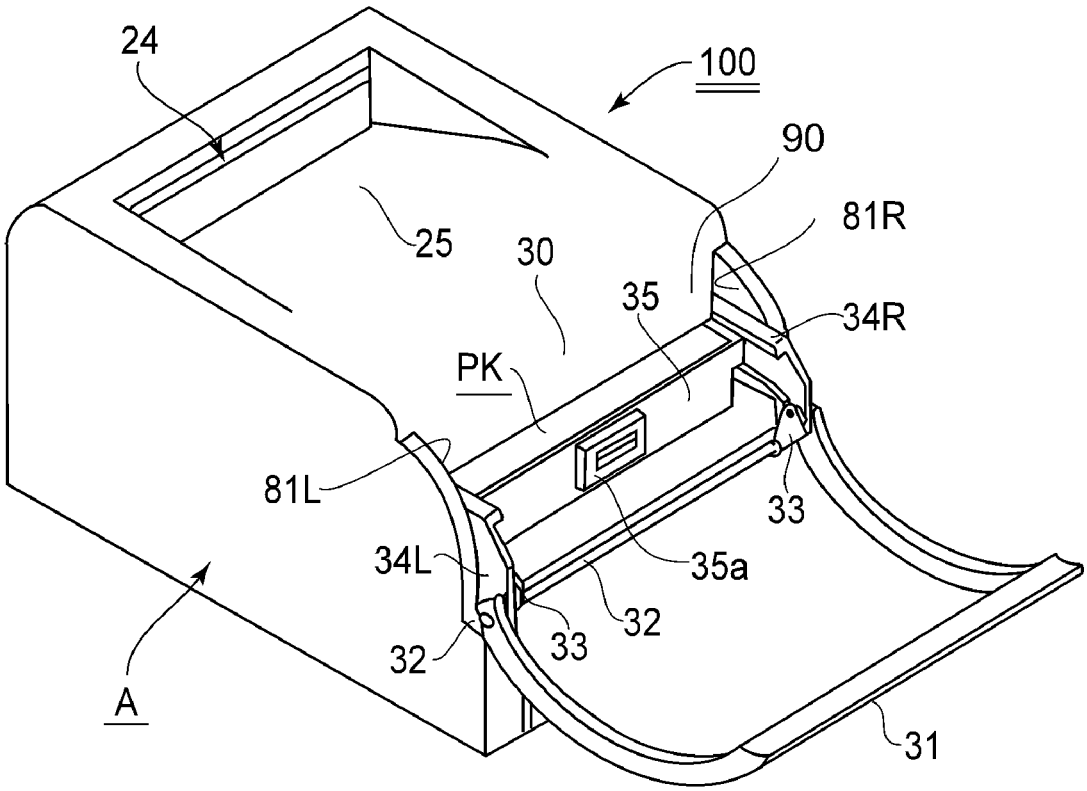
FIG. 2A is a perspective view of an outer appearance of the image forming apparatus in a state in which the openable door is opened.
Figure 2B:
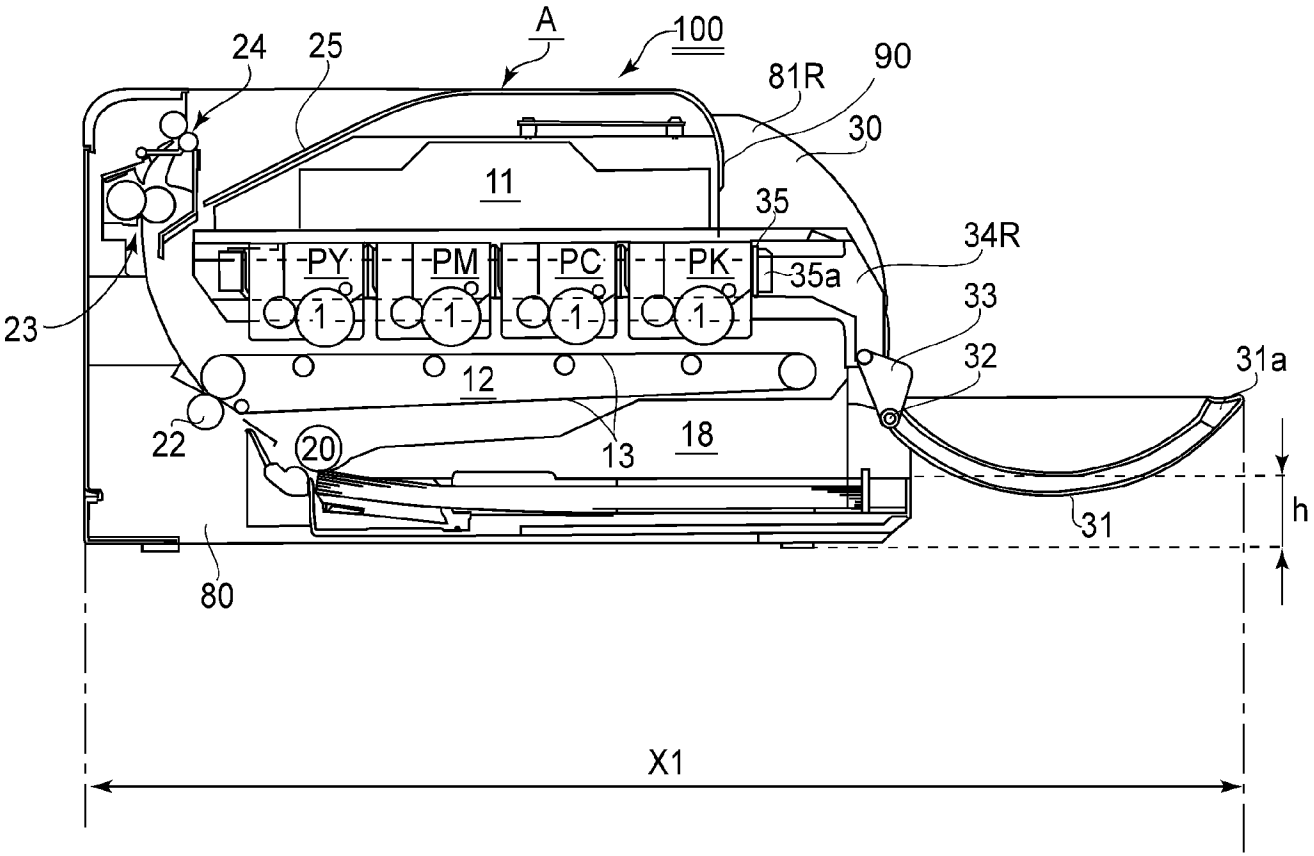
FIG. 2B is a longitudinal left side view of the image forming apparatus.

In this embodiment, the door 31 can be opened and closed and can be rotationally moved relative to the apparatus main assembly A about a horizontal (hinge) shaft 32 provided at a lower portion of the door 31. That is, the door 31 is rotated about the hinge shaft 32 so that it can be moved backward into the closed position to place the opening 30 in a closed (covered) state as shown in FIGS. 1A and 1B. By the closing of the door 31, the opening 30 is closed (covered). Further, the door 31 can be rotated forward about the hinge shaft 32 into the open position, as shown in FIGS. 2A and 2B, to place the opening 30 in an opened state with respect to the apparatus main assembly A. As a result, the opening 30 is considerably exposed. To the door 31, a holding (grip) portion 31*a* is provided.

Inside left and right frames 80L and 80R of a main frame 80 of the apparatus main assembly A, a pair of left and right tray holding members (movable means) 34L and 34R is disposed, respectively (FIG. 2A). These tray holding members 34L and 34R oppose each other. A longitudinal (lengthwise) direction of each of the tray holding members 34L and 34R coincides with the front-rear direction of the apparatus main assembly A. Between the left and right tray holding members 34L and 34R, the tray (movable member) 35 is held horizontally slidably in the front-rear direction of the apparatus main assembly A. The cartridges PY, PM, PC and PK are supported by the tray 35. The door 31 and the left and right tray holding members 34L and 34R are connected through a door link 33. The tray holding members 34L and 34R are configured to move forward and upward by a predetermined distance by a guide means (not shown) in interrelation with the opening rotation of the door 31. As a result, front portions of the tray holding members 34L and 34R are pulled out to a position in which the front portions are located outside the apparatus main assembly A by a predetermined distance as shown in FIGS. 2A and 2B.

In interrelation with the above-described movement of the tray holding members 34L and 34R, drive output portions on the apparatus main assembly side are disengaged from corresponding drive input portions of each of the cartridges PY, PM, PC and PK (driven portion disengagement). Further, the urging by the urging member which positions and fixes each cartridge is released (urging release). Further, electrical conduction of the electric energy supplying system on the apparatus main assembly A side to the electrical contacts of each cartridge is ceased (electrical disconnection). Further, the positioning and fixing of the tray 35 by a tray movement preventing means (not shown) with respect to the apparatus main assembly A is released.

By the movement of the tray holding members 34L and 34R as described above, the tray 35 and the respective cartridges PY, PM, PC and PK are also moved forward and upward together with the tray holding members 34L and 34R, so that the drum 1 is separated from the belt 13 (FIG. 2B). That is, the tray 35 is moved from the transfer contact position (inside position shown in FIG. 1B) in which the drum 1 and the belt 13 contact each other to the transfer separation position (pushed-in position) in which the drum 1 and the belt 13 are separated from each other.

Figure 3A:
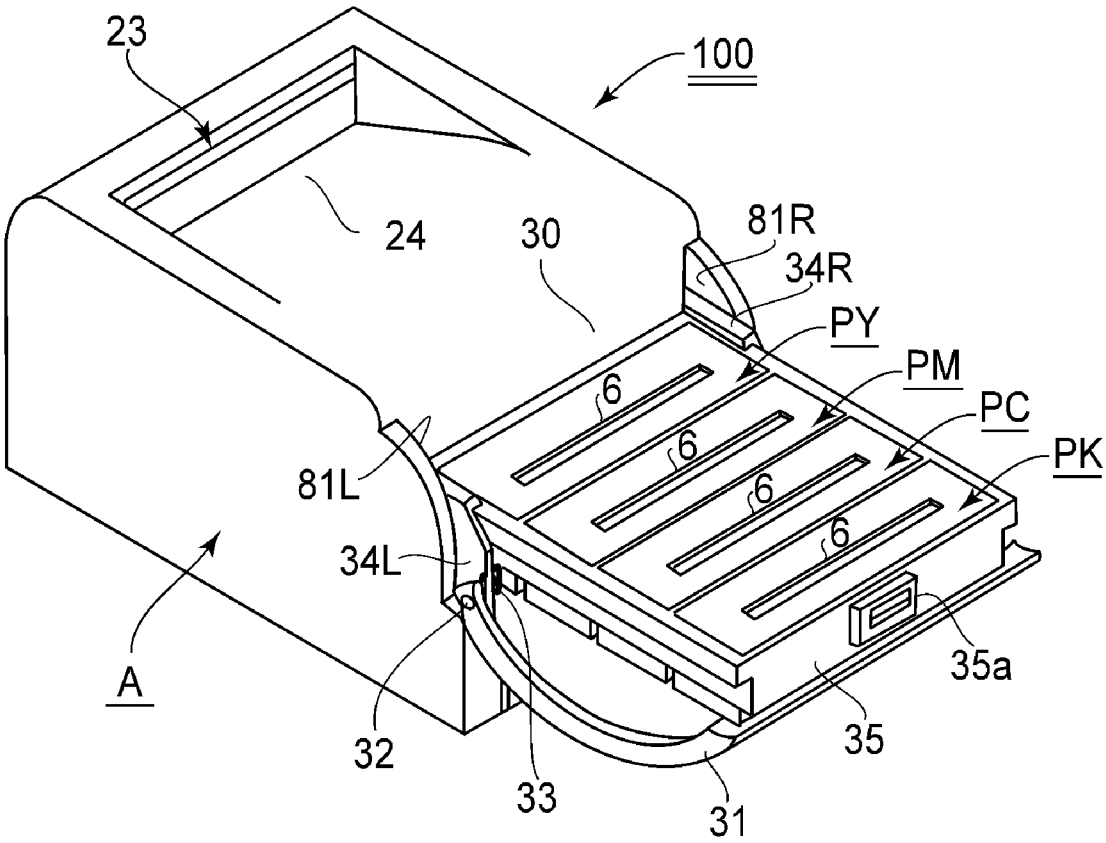
FIG. 3A is a perspective view of an outer appearance of the image forming apparatus in a state in which a tray is pulled out from the state shown in FIG. 2A.
Figure 3B:
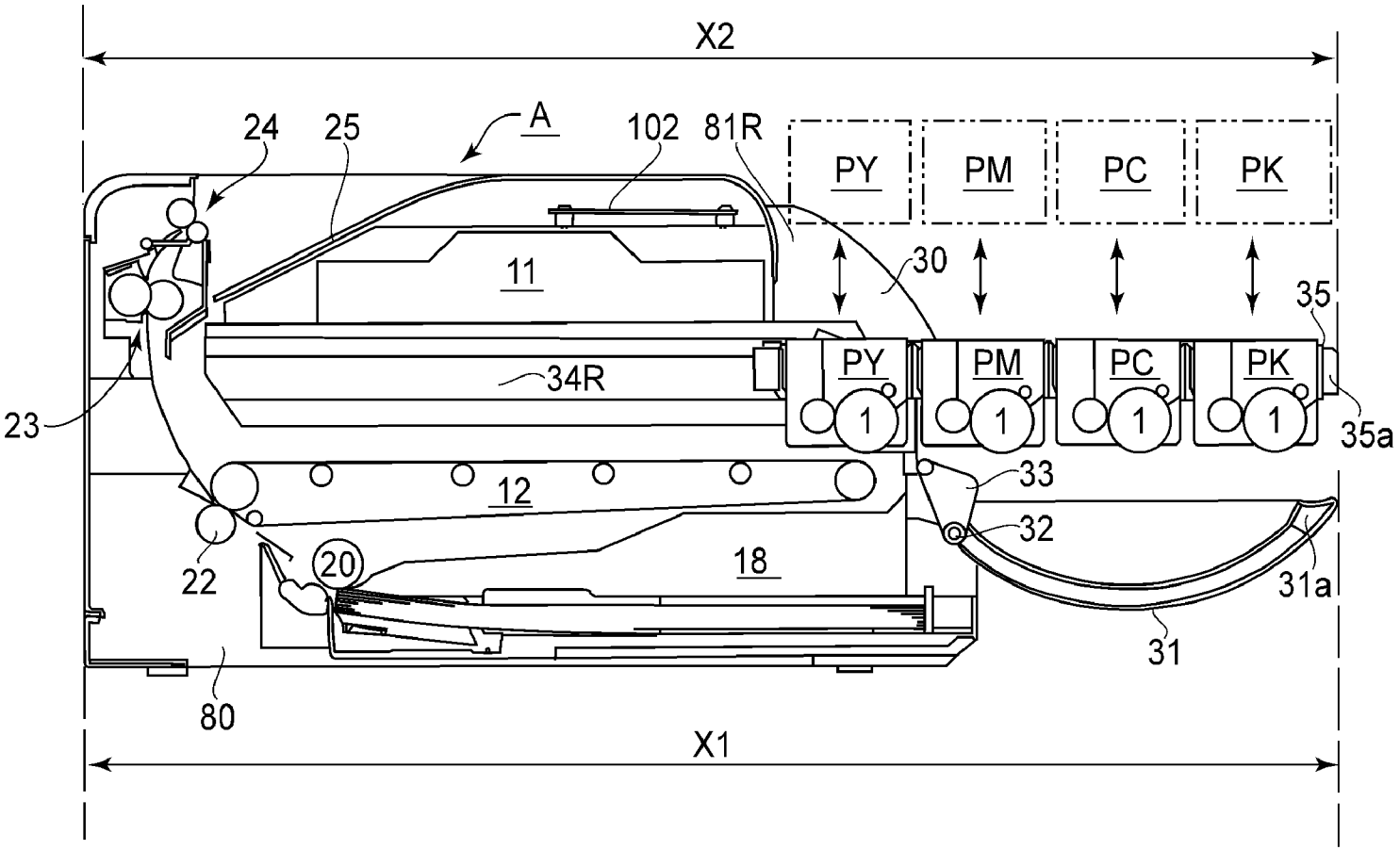
FIG. 3B is a longitudinal left side view the image forming apparatus.

Then, the user grips the grip portion 35*a* exposed from the opening 30 at the front surface of the tray 35 and horizontally slides and moves forward the tray 35 with respect to the tray holding members 34L and 34R. Then, as shown in FIGS. 3A and 3B, the tray 35 is sufficiently pulled out through the opening 30 to a predetermined pulled-out position located outside the apparatus main assembly A. That is, the tray 35 is sufficiently pulled out to the outward position in which the tray 35 is located at the outermost position outside the apparatus main assembly A.

During this pull-out movement of the tray 35, the drum 1 of each cartridge and the belt 13 are separated from each other, so that friction therebetween is not caused to occur.

The tray 35 supports the plurality of cartridges PY, PM, PC and PK so that the cartridges are successively demountable from the most downstream cartridge with respect to its movement direction during movement thereof from the set position to the outward position. At the outward position, all the plurality of cartridges are demountable.

That is, the entire first to fourth (four) cartridges PY, PM, PC and PK held by the tray 35 pass through the opening 30 to be exposed to the outside of the apparatus main assembly A, so that the upper surfaces of all the cartridges are exposed. When the tray 35 is pulled out with a predetermined sufficient distance, further pull-out movement of the tray 35 is prevented by a stopper portion (not shown). Further, the tray 35 is stably held, in the state in which it is horizontally pulled out to the outward position, by the tray holding members 34L and 34R.

The tray 35 supports each cartridge P so as to be detachably movable directly above. The tray 35 supports each cartridge P by moving each cartridge P directly below. As shown by chain double-dashed lines in FIG. 3B, a spent cartridge P to be replaced is raised and removed above from the tray 35. Then, a fresh cartridge is engaged in and placed on the tray from above.

That is, the tray 35 is configured so that the tray 35 is horizontally moved to the outward position in which the tray 35 demountably supports the individual cartridges directly above and also supports the individual cartridges by moving the cartridges directly below. As a result, it is possible to provide the image forming apparatus improved in operatively such that the cartridges are inserted into the tray 35.

When a cartridge, to be exchanged, of the cartridges held on the tray 35 is exchanged, the user sufficiently pushes and moves the tray 35 into the apparatus main assembly to be accommodated at the pushed-in position inside the apparatus main assembly. That is, the tray 35 is returned to the state before the pulling out as shown in FIGS. 2A and 2B. Also during the push-in movement of the tray 35, the drum 1 of each of the cartridges PY, PM, PC and PK and the belt 13 are separated from each other, so that friction therebetween is not caused to occur.

After the tray 35 is sufficiently pushed in to the pushed-in position, the door 31 is closed. In interrelation with the closing rotation of the door 31, the tray holding members 34L and 34R are moved backward and downward by a predetermined distance by a guide means (not shown). As a result, the tray and each cartridge are also moved backward and downward together with the tray holding members 34L and 34R, so that the drum 1 contacts the belt 13 (FIG. 1A). That is, the tray 35 is moved from the transfer separation position in which the drum 1 and the belt 13 are separated from each other to the transfer contact position in which the drum 1 and the belt 13 are brought into contact with each other.

Further, in interrelation with the movement of the tray holding members 34L and 34R, each cartridge is urged by the urging member to be held in the state in which the cartridge is fixed (locked) to the predetermined positioning portion. To the drive input portion of the cartridge, the drive output portion on the apparatus main assembly side is connected. To the electrical contacts of the cartridge, the electric energy supplying system on the apparatus main assembly side is electrically connected. Further, the tray 35 is positioned to the apparatus main assembly A by the tray movement preventing means.

In this embodiment, the tray 35 is the movable member provided movably between the inside and the outside of the apparatus main assembly A in a direction intersecting the longitudinal direction (axial direction) of the drum 1 of each cartridge. Further, the tray 35 is the movable member movable between the outward position in which the tray 35 having passed through the opening 30 is located outside the apparatus main assembly A and each cartridge is mountable to and demountable from the apparatus main assembly A and a latent image forming position in which the electrostatic latent image can be formed on the drum 1. In this embodiment, the tray 35 supports the cartridges PK, PC, PM and PY accommodating the develops of black (K), cyan (C), magenta (M) and yellow (Y), respectively, side by side in this order from the upstream side to the downstream side with respect to the tray movement direction from the outside to the inside of the apparatus main assembly A. Thus, according to this embodiment, the cartridge PK in which the developer is consumed in the largest amount, i.e., with a high exchange frequency is disposed on the side closest to the front side. Therefore, the cartridge PK can be exposed outside the apparatus main assembly A only by pulling out the tray 35 by a small distance. Thus, it was possible to improve exchange operatively of the cartridge PK. Further, the left and right tray holding members 34L and 34R are movable means for moving the tray 35 from the set position in the upward direction and toward the set position in the downward direction before the tray 35 as the movable member is moved to the outward position in which each cartridge is detachably mountable. In other words, the tray holding members 34L and 34R are a supporting member for supporting the tray 35 and can take a second position for permitting movement of the tray 35 between the outward position and the set position and can take the first position for permitting positioning of the tray 35 at the transfer contact position (latent image forming position). Further, in interrelation with the closing of the door 31, the tray holding members 34L and 34R are moved from the second position to the first position.

Next, an interaction between the tray 35 and the door 31 during the cartridge exchange will be described. A footprint of the image forming apparatus placed in a state in which the door 31 is opened is X1 as shown in FIG. 2B in terms of a dimension with respect to the front-rear direction of the apparatus main assembly A. The user is required to ensure a space for opening the door 31 forward and closing the door 31 backward with respect to the apparatus main assembly A when the user mounts the image forming apparatus, so that the image forming apparatus requires a length of X1 with respect to the front-rear direction as a whole. The footprint of the image forming apparatus placed in a state in which the tray 35 is pulled out from the inside of the apparatus main assembly A to the outermost position to be located at the outward position is X2 as shown in FIG. 3B in terms of the dimension with respect to the front-rear direction of the apparatus main assembly A. In this embodiment, as shown in FIG. 3B, a relationship of $X1 \geqq X2$ is satisfied, so that the outermost end of the tray 35 is not located outside that of the door 31. That is, the door 31 located at the open position is located below the tray 35 located at the outward position. The outermost end of the tray 35 located at the outward position is vertically aligned with or located inside the outermost end of the door 31. As a result, it is possible to not only insert the plurality of cartridges into the apparatus main assembly A in a state in which the cartridges are mounted to the tray 35 but also obviate a new disposing space for pulling out and pushing in the tray 35, so that the user is only required to ensure a minimum necessary disposing area. Further, as shown in FIGS. 3A and 3B, when the tray 35 is pulled out to the outward position, the surface of the photosensitive drum 1 exposed at the lower surface of each of the cartridges PY, PM, PC and PK can be covered and protected with the door 31 placed in the open state. As a result, it is not only possible for the user to erroneously touch the surface of the drum 1 but also possible to prevent deposition of a foreign matter such as dust or dirt on the drum 1.

The constitution of the image forming apparatus of Embodiment 1 described above is summarized as follows.

(1) The image forming apparatus forms the image on the recording material S. The image forming apparatus includes the opening 30 provided to the apparatus main assembly A of the image forming apparatus and includes the openable member 31 movable between the closed position in which the opening 30 is covered (closed) and the open position in which the opening 30 is exposed (opened). Further, the image forming apparatus includes the movable member 35 capable of supporting the plurality of cartridges, side by side, each including at least one of the image bearing member 1 on which the latent image is to be formed and the developing means 3 for developing with the developer the latent image formed on the image bearing member 1. The movable member 35 is movable between the set position inside the apparatus main assembly A and the outward position in which the movable member 35 having passed through the opening 30 is located at the outermost position of the movable range of the movable member 35. By the movable member 35, the plurality of cartridges is supported side by side with respect to the movement direction of the movable member 35. The openable member 31 located at the open position is located below the movable member 35 located at the outward position. The outermost end of the movable member 35 located at the outward position is vertically aligned with or located inside the outermost end of the openable member 31. Further, the image forming apparatus includes the vertical wall portion 90, provided close to an upper portion of the openable member 31 at the closed position of the openable member 31. The vertical wall portion 90 protects the scanner unit 11. By this constitution, the plurality of cartridges can be inserted into the apparatus main assembly A in the state in which the cartridges are supported by the movable member 35. Further, the area required during the inserting operation can be only the area required for opening and closing the openable member 31. For that reason, it is possible to provide the image forming apparatus which is reduced in the disposing area required for the image forming apparatus to be improved in space-saving property. Further, the openable member 31 located at the open position can protect the cartridges, so that it is possible for the user to erroneously touch the image bearing member or the developing means.

(2) The movable member 35 is linearly movable in the direction perpendicular to the longitudinal direction of the image bearing member or the developing means of each of the cartridges.

(3) The movable member 35 supports the plurality of cartridges PY, PM, PC and PK so that the cartridges can be successively demountable from the most downstream cartridge with respect to the movement direction of the movable member 35 during the movement of the movable member 35 from the set position to the outward position. At the outward position, all the plurality of cartridges are demountable.

Embodiment 2

Figure 4A:
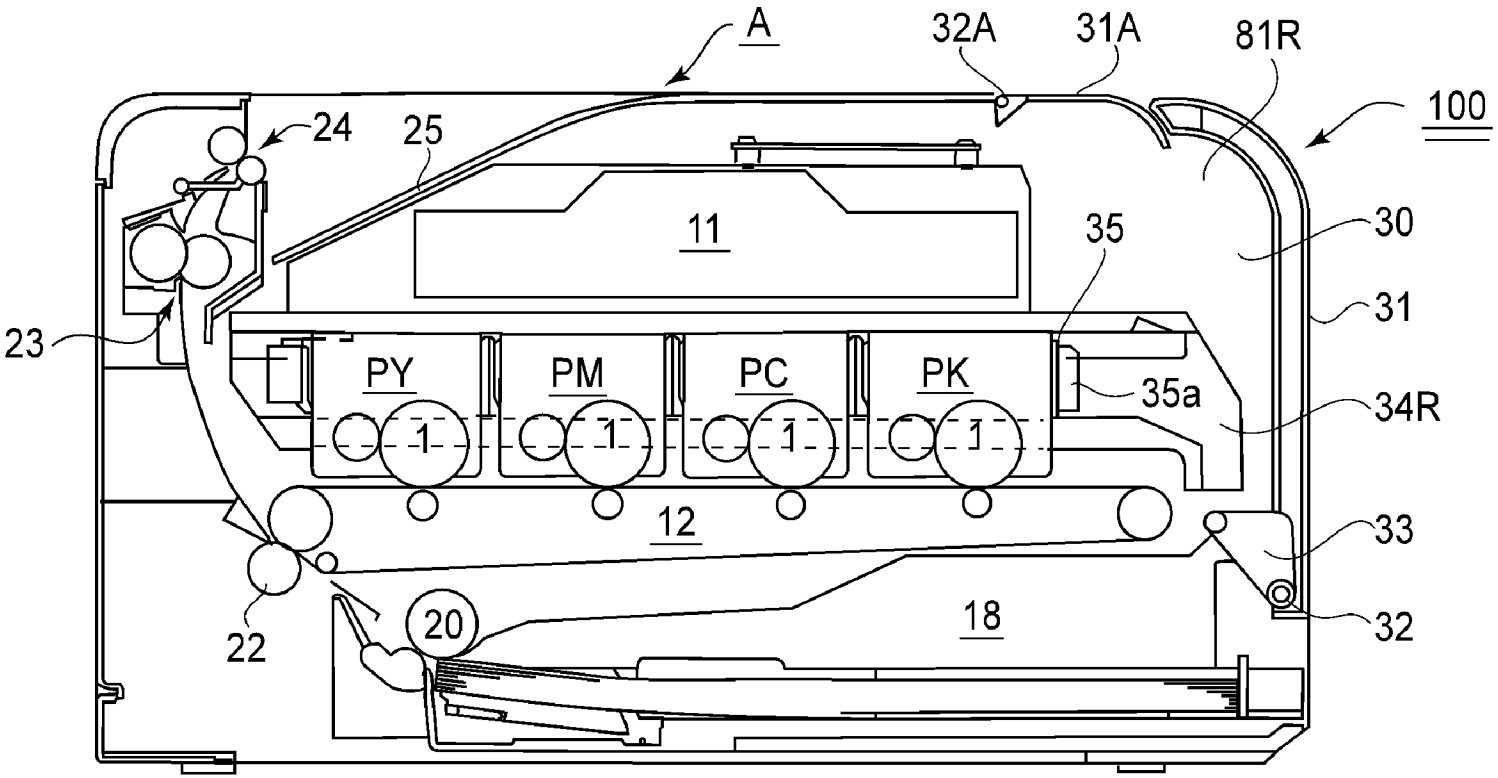
FIGS. 4A, 4B and 4C are schematic views for illustrating a constitution of an image forming apparatus in Embodiment 2.
Figure 4B:
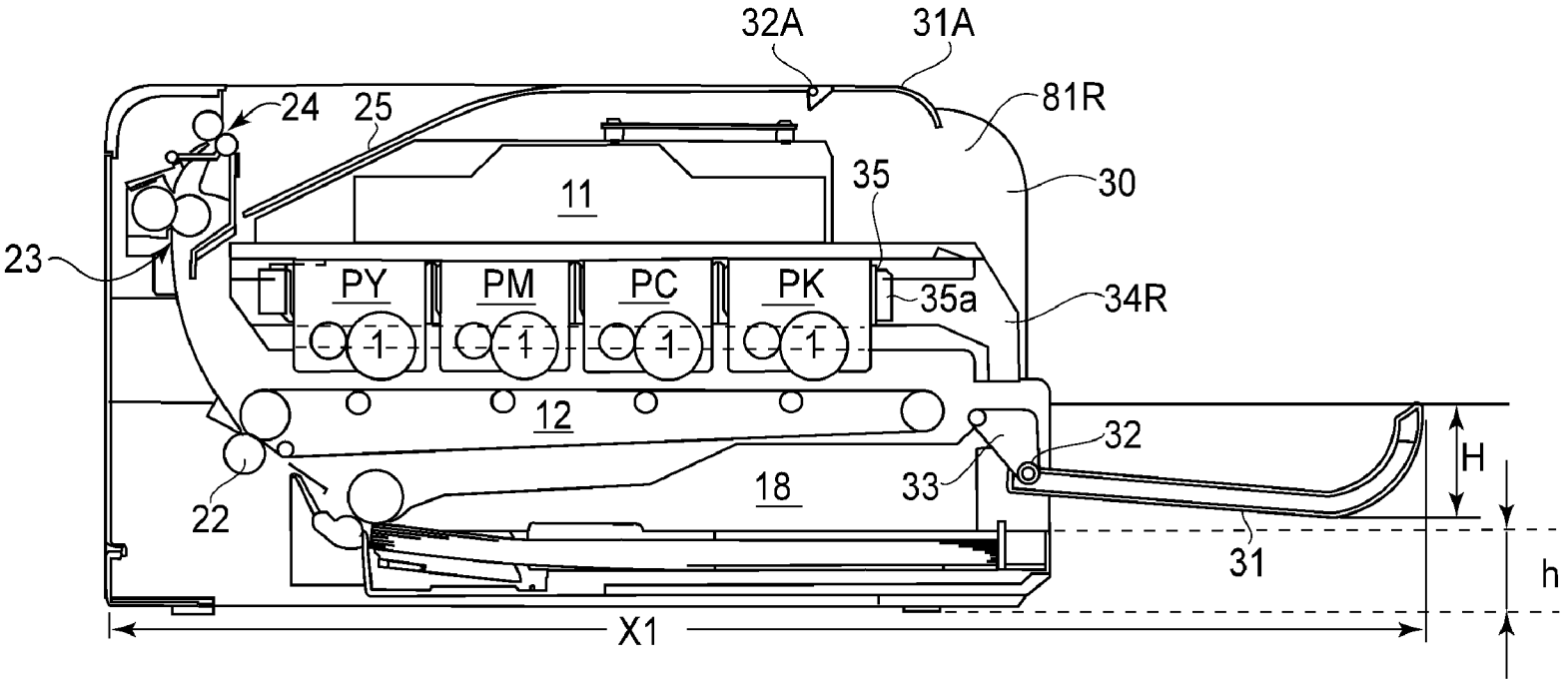
Figure 4C:
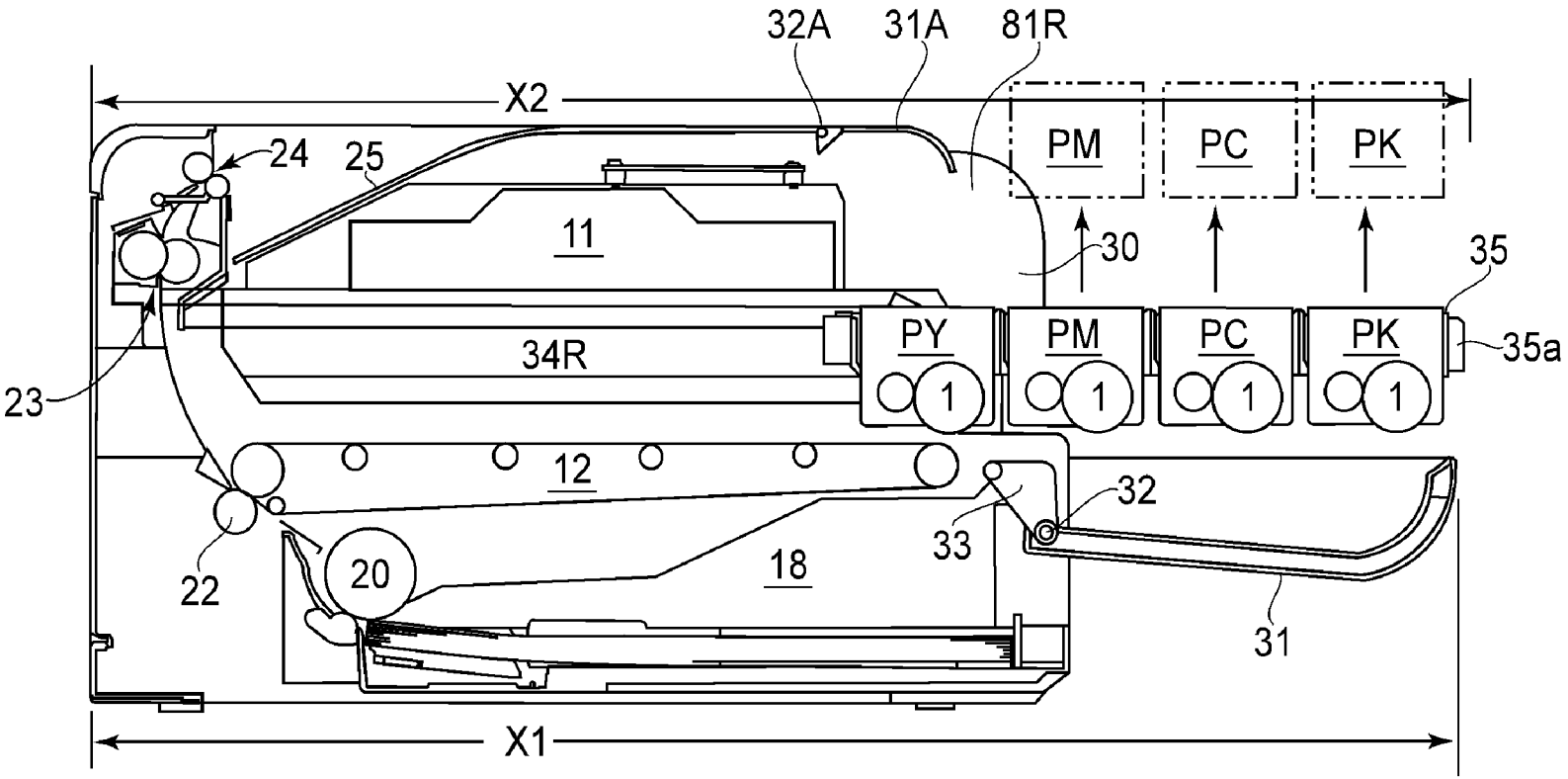
Figure 5A:
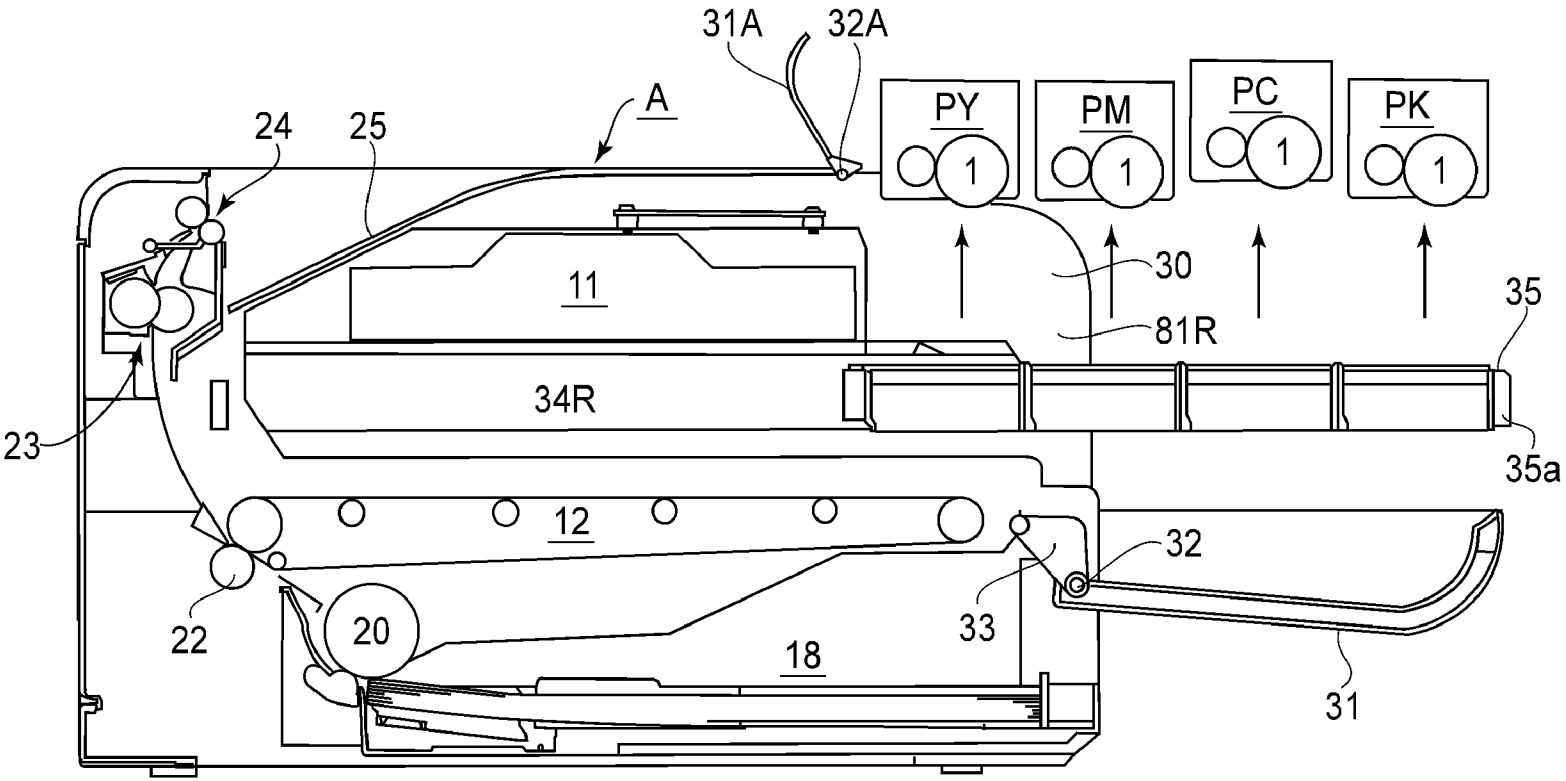
FIG. 5A is a schematic view for illustrating the constitution of the image forming apparatus in Embodiment 2.

Embodiment 2 will be described with reference to FIGS. 4 and 5A. The image forming apparatus 100 in this embodiment include a first door (first openable member) 31 and a second door (second openable member) 31A which are configured to open (expose) and close (cover) the opening 30 provided to the apparatus main assembly A. The first door 31 is movable between a closed position in which a front surface portion (first portion) of the opening 30 and an open position in which the front surface portion is opened. The second door 31A is movable between an upper surface portion (second portion) of the opening 30 and an open position in which the upper surface portion is opened. More specifically, the first door can be opened and closed and can be rotationally moved relative to the apparatus main assembly A about a horizontal (hinge) shaft 32 provided at a lower portion of the door 31 similarly as in the case of the door 31 of the image forming apparatus 100 in Embodiment 1. That is, the first door 31 is rotated about the hinge shaft 32 so that it can be moved backward into the closed position to place the front portion of the opening 30 in a closed (covered) state as shown in FIG. 4A. By the closing of the door 31, the front portion of the opening 30 is closed (covered). Further, the door 31 can be rotated forward about the hinge shaft 32 into the open position, as shown in FIG. 4B, to place the front portion of the opening 30 in an opened state with respect to the apparatus main assembly A. As a result, the front portion of the opening 30 is considerably exposed. Further, the second door 31A is rotated forward about a hinge shaft 32A, so that the second door 31A can be placed in the closed state with respect to the upper surface portion of the opening 30 as shown in FIGS. 4A, 4B and 4C. Further, the second door 31A is rotated upward and backward to be placed in a state in which the second door is opened with respect to the apparatus main assembly A as shown in FIG. 5A. As a result, the upper portion of the opening 30 is exposed. In this embodiment, the second door 31A can be subjected to the opening and closing operation in the state in which the first door 31 is opened. Further, similarly as in the case of the door 31 in Embodiment 1, in interrelation with the opening and closing operation of the first door 31, the left and right tray holding members 34L and 34R are moved from the first position to the second position and also moved from the second position to the first position. Other constitutions of the image forming apparatus are similar to those of the image forming apparatus in Embodiment 1, thus being omitted from redundant description. FIG. 4A shows a state in which the first door 31 and the second door 31A are closed. In this state, the image forming apparatus can perform the image forming operation. FIG. 4B shows a state in which the first door 31 is opened. In this state, the left and right tray holding members 34L and 34R are held in the state in which they are moved from the first position to the second position, and the tray 35 is slidably movable along the tray holding members 34L and 34R. FIG. 4C shows a state in which the tray 35 placed in the state of FIG. 4B is located at the outward position by pulling out the tray 35 from the inside of the apparatus main assembly A to the outermost position of the tray 35. In this state, the cartridge PY located most upstream with respect to the movement direction of the tray 35 is located below the closed second door 31A. Other cartridge PM, PC and PK located downstream of the cartridge PY are pulled out so as to be located from the front side of the opening 30 toward the outside of the apparatus main assembly A. Therefore, in this state, the second, third and fourth cartridges PM, PC and PK are demountable. FIG. 5A shows a state in which the second door 31A placed in the state of FIG. 4C is opened. In this state, the upper surface portion of the opening 30 is exposed, so that the first cartridge PY can also be demounted from the tray 35 in the directly above direction. That is, the second door 31A may be opened only when the first cartridge PY located on the most upstream side with respect to the movement direction of the tray 35.

Figure 5B:
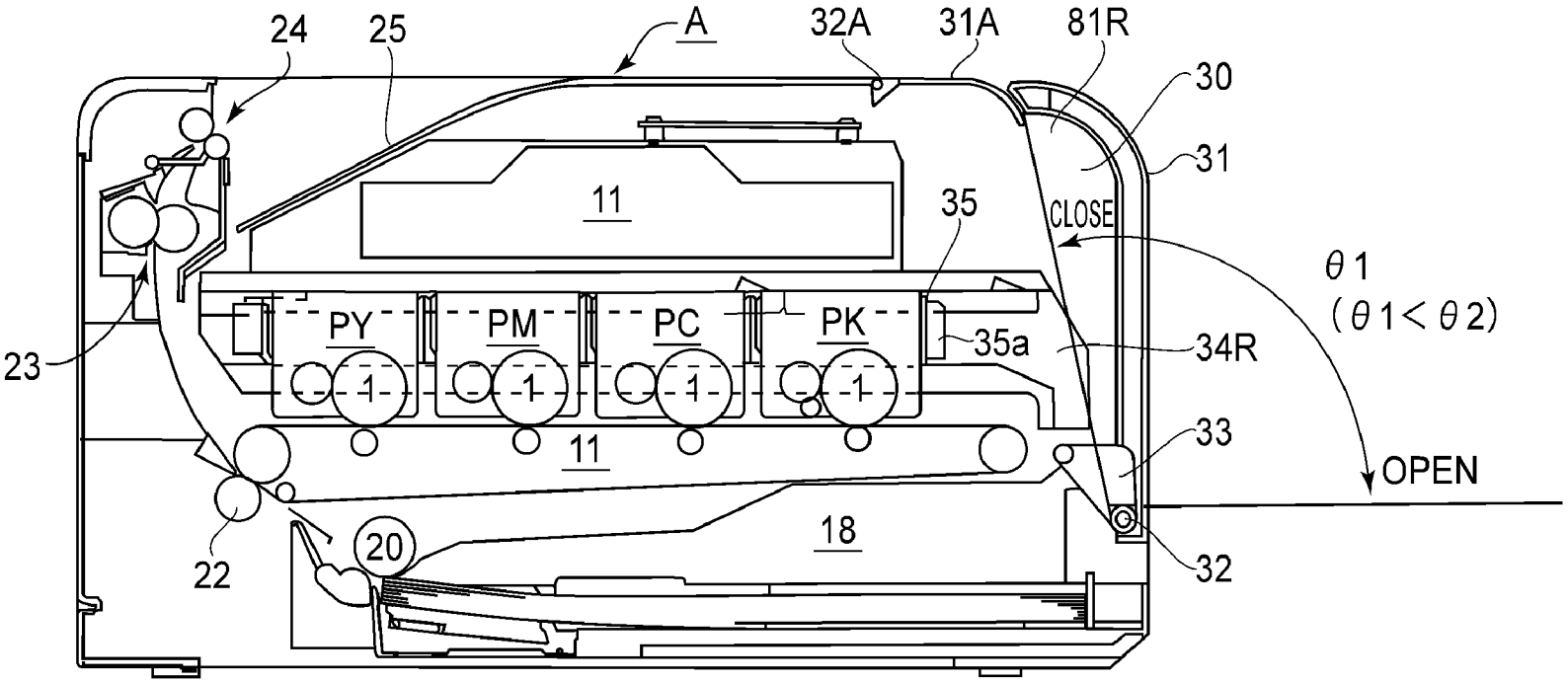
FIG. 5B is a schematic view showing an angle θ1 necessary to open and close the door of the image forming apparatus in Embodiment 2.
Figure 5C:
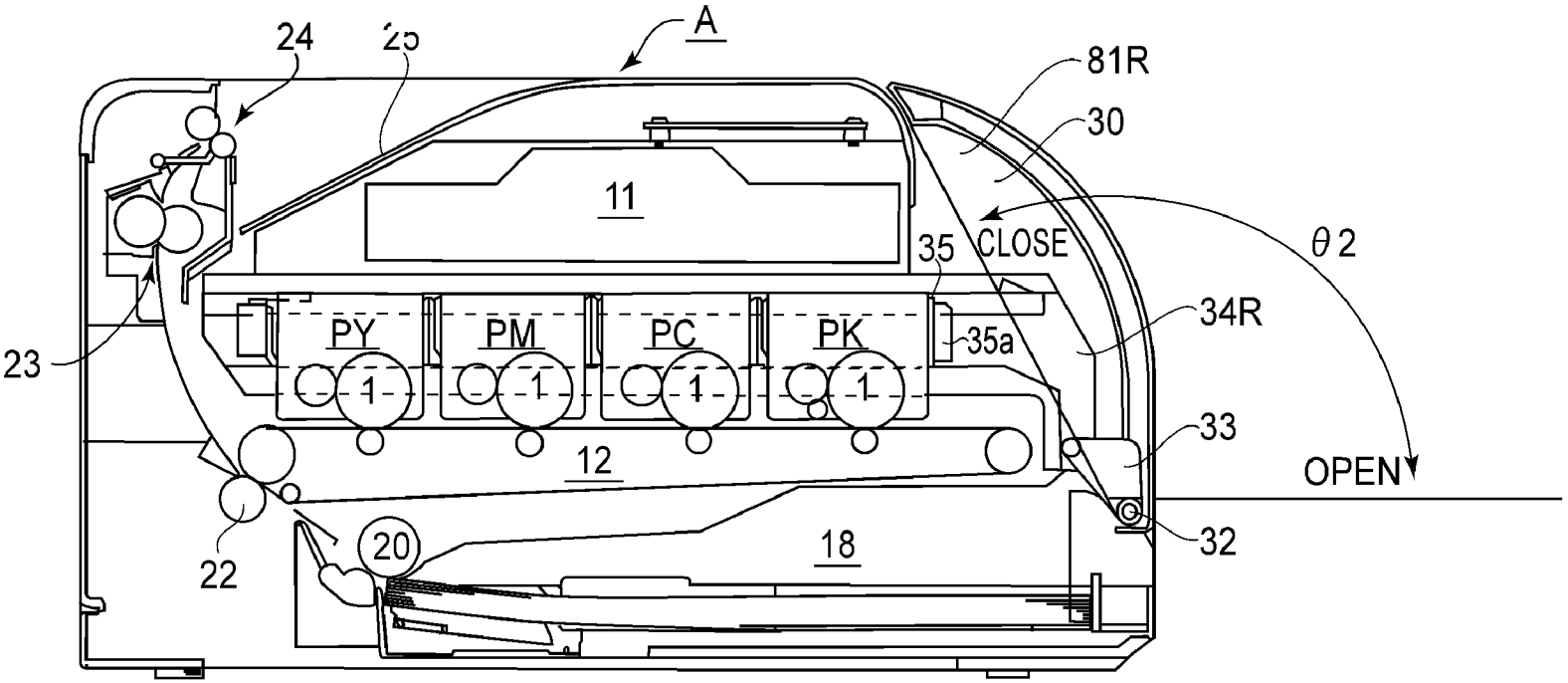
FIG. 5C is a schematic view showing an angle θ2 necessary to open and close the door of the image forming apparatus in Embodiment 1.
Figure 6:
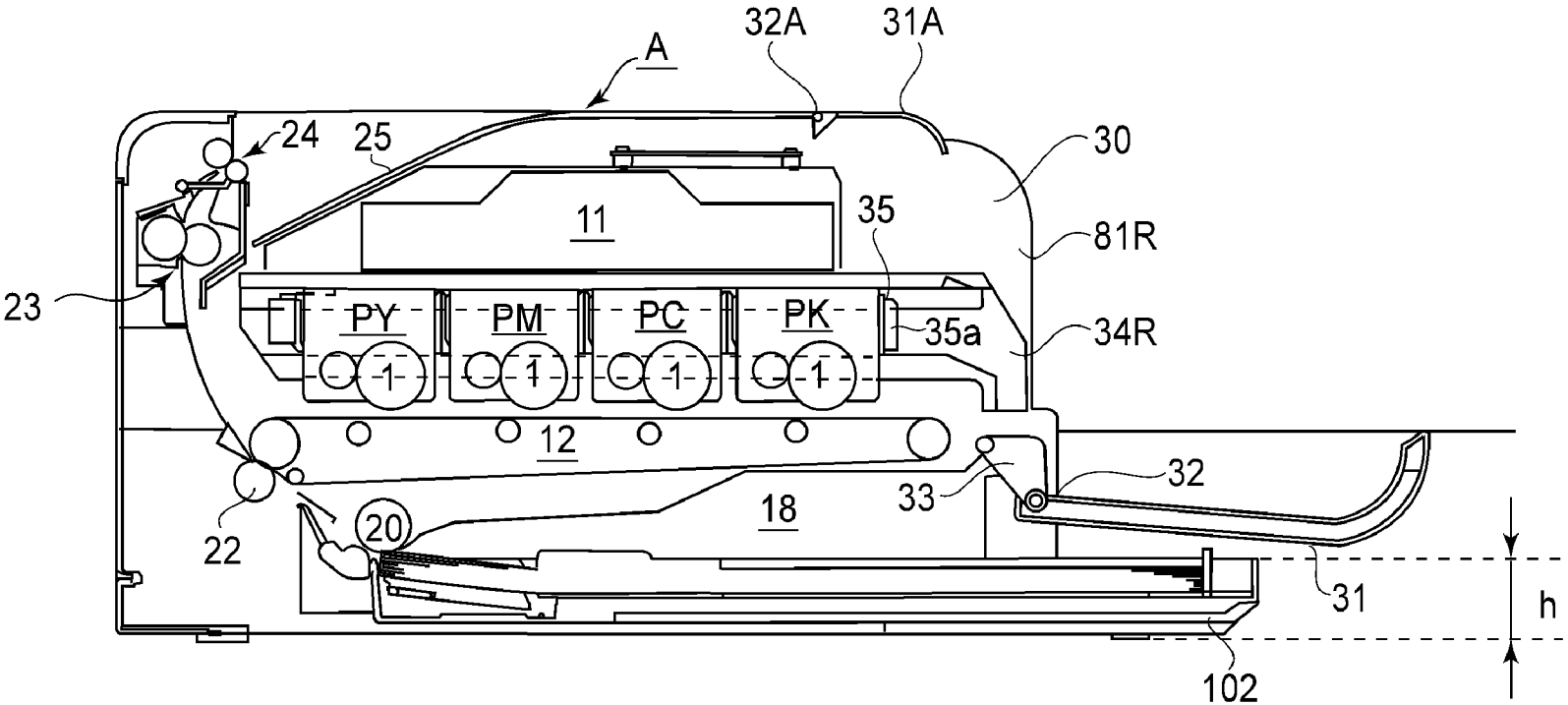
FIG. 6 is a schematic view for illustrating the constitution of the image forming apparatus in Embodiment 2.

Also, in the image forming apparatus in this embodiment, the interrelation between the tray 35 and the first door 31 is identical to that in the image forming apparatus in Embodiment 1. That is, a footprint of the image forming apparatus placed in a state in which the first door 31 is opened is X1 as shown in FIG. 2B in terms of a dimension with respect to the front-rear direction of the apparatus main assembly A. The footprint of the image forming apparatus placed in a state in which the first door 31 is opened and then the tray 35 is pulled out from the inside of the apparatus main assembly A to the outermost position to be located at the outward position is X2 as shown in FIG. 4C in terms of the dimension with respect to the front-rear direction of the apparatus main assembly A. In this embodiment, a relationship of $X1 \geqq X2$ is satisfied, so that the outermost end of the tray 35 is not located outside that of the first door 31. That is, the first door 31 located at the open position is located below the tray 35 located at the outward position. The outermost end of the tray 35 located at the outward position is vertically aligned with or located inside the outermost end of the first door 31. As a result, it is possible to not only insert the plurality of cartridges into the apparatus main assembly A of the image forming apparatus in a state in which the cartridges are mounted to the tray 35 but also obviate a new disposing space for pulling out and pushing in the tray 35, so that the user is only required to ensure a minimum necessary disposing area. Further, as shown in FIG. 4C, when the tray 35 is pulled out to the outward position, the first cartridge PY is located inside the apparatus main assembly A. Further, the surface of the photosensitive drum 1 exposed at the lower surface of each of other cartridges PM, PC and PK is covered and protected with the first door 31 placed in the open state. As a result, it is not only possible for the user to erroneously touch the surface of the drum 1 but also possible to prevent deposition of a foreign matter such as dust or dirt on the drum 1. Further, when the door is configured to be divided into the first door 31 and the second door 31A as in this embodiment, an angle required for opening and closing the first door 31 can be lowered to a small value. In FIG. 5B, $\theta 1$ represents the angle require for opening and closing the first door 31 in this embodiment. In FIG. 5C, $\theta 2$ represents an angle required for opening and closing the door 31 of the image forming apparatus in Embodiment 1. The relationship: $\theta 1 < \theta 2$ is satisfied. Further, by dividing the door into the two portions. A thickness required for the first door 31 (a dimension H is a height direction of the first door 31 shown in FIG. 4B) can be made thin. When the angle for opening and closing the first door 31 can be lowered to the small level and the thickness of the first door 31 can be made thin, the following advantages can be obtained. That is, as shown in FIG. 6, e.g., a retractable cassette 102 (stacking member) configured to accommodate large-sized sheets, such as regal-sized paper, larger in size than the apparatus main assembly A is mounted to the image forming apparatus for printing. The retractable cassette 102 is partly projected from the first door 31 located in the closed position toward the outside of the apparatus main assembly A with respect to the direction in which the tray 35 is movable from the set position to the outward position. The first door 31 and the second door 31A are configured so that the first door 31 located at the open position does not interfere with the cassette 102. The cassette 102 is configured so that the outermost end thereof is vertically aligned with the outermost end of the first door 31 located at the closed position or is configured to be retractable inside the outermost end of the first door with respect to the direction in which the tray 35 is moved from the set position to the outward position. As shown in FIGS. 2B and 4B, by the division of the door into the two portions, when the first door 31 is opened, it is possible to easily ensure a height h of the cassette 102 at a portion below the first door 31. As a result, the height of the apparatus main assembly A can be minimized and the image forming apparatus main assembly can be downsized. At the same time, it is possible to not only increase an amount of sheets stacked in the cassette 102 but also considerably increase the size and the type of sheets usable by the user. In addition, the opening and closing of the second door 31A are only required when the rearmost cartridge PY is demounted, so that a possibility that a foreign matter such as dust or dirt falls through the opening 30 of the apparatus main assembly A to be deposited on the surface of the intermediary transfer belt 13 can be minimized.

The constitution of the image forming apparatus of Embodiment 2 described above is summarized as follows.

(1) The image forming apparatus forms the image on the recording material S. The image forming apparatus includes the opening 30 provided to the apparatus main assembly A of the image forming apparatus and includes the first openable member 31 movable between the closed position in which a first portion of the opening 30 is covered (closed) and the open position in which the first portion of the opening 30 is exposed (opened). The image forming apparatus includes the second openable member 31A movable between the closed position in which a second portion of the opening 30 is covered and the open position in which the second portion of the opening 30 is exposed and includes the movable member 35 movable between the set position located inside the apparatus main assembly A and the outward position in which the movable member 35 having passed through the first portion of the opening 30 is located at the outermost position in the movable range of the movable member 35. Further, in the movement direction, the movable member 35 is capable of supporting the plurality of cartridges, side by side, each including at least one of the image bearing member 1 on which the latent image is to be formed and the developing means 3 for developing with the developer the latent image formed on the image bearing member 1. The first openable member 31 located at the open position is located below the movable member 35 located at the outward position. The outermost end of the movable member 35 located at the outward position is vertically aligned with or located inside the outermost end of the first openable member 31.

(2) The movable member 35 is linearly movable in the direction perpendicular to the longitudinal direction of the image bearing member 1 or the developing means 3 of each of the cartridges supported thereby.

(3) The movable member 35 supports the plurality of cartridges PY, PM, PC and PK so that the cartridges can be successively demountable from the most downstream cartridge with respect to the movement direction of the movable member 35 during the movement of the movable member 35 from the set position to the outward position. At the outward position, all the plurality of cartridges are demountable when the second openable member 31A is located at the open position.

(4) The movable member 35 is horizontally movable, and at the outward position, the movable member 35 supports the cartridges so as to be demountable right above and supports the cartridges by moving the cartridges right below.

(5) The image forming apparatus further includes a stacking member 102, partly projecting from a position vertically aligned with the closed position of the first openable member 31 toward an outside of the apparatus main assembly A with respect to a direction in which the movable member 35 is movable from the set position to the outward position, for stacking the recording material S. The first openable member 31 and the second openable member 31A are configured so that the first openable member 31 does not interfere with the stacking member 102 when the first openable member 31 is located at the open position.

(6) The stacking member 102 is configured so as to be retractable to a position vertically aligned with a position of the outermost end of the first openable member 31 located at the closed position with respect to the direction in which the movable member 35 is movable from the set position to the outward position or is configured to be located inside the position of the outermost end of the first openable member 31.

In the above-described Embodiments 1 and 2, the cartridge is the process cartridge prepared by integrally supporting the image bearing member 1 and the process means, acting on the image bearing member 1, consisting of the charging means 2, the developing means 3 and the cleaning means 4 into a cartridge but is not limited thereto. That is, the cartridge may only be required to include at least the image bearing member on which the latent image is to be formed and the developing means for developing the latent image, formed on the image bearing member, with the developer. The process means is, e.g., at leas one of the charging means, the developing means, and the cleaning means. The image bearing member is the member on which the latent image to be developed with the developer is to be formed. The image bearing member may also be the electrostatic recording dielectric member in the electrostatic recording process, the magnetic recording magnetic member in the magnetic recording process, and the like, in addition to the electrophotographic photosensitive member in the electrophotographic process as in the embodiments.

In the above-described Embodiments 1 and 2, the tray 35 as the movable member is configured to support the four cartridges PY, PM, PC and PK disposed in parallel to each other with respect to the movement direction of the tray 35. In addition thereto, it is also possible to constitute the image forming apparatus in which two, three or five or more cartridge are supportable side by side on the tray 35.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 271782/2008 filed Oct. 22, 2008 and 214303/2009 filed Sep. 16, 2009, which are hereby incorporated by reference.

What is claimed is:

1. An image forming apparatus for forming an image on a recording material, comprising:

an opening provided to a main assembly of said image forming apparatus;

a first openable member movable between a closed position in which a first portion of said opening is closed and an open position in which the first portion of said opening is opened;

a second openable member movable between a closed position in which a second portion of said opening is closed and an open position in which the second position of said opening is opened; and a movable member, movable between a set position inside the main assembly and an outward position in which said movable member having passed through the first portion of said opening is located at an outermost position in a movable range of said movable member, capable of supporting a plurality of cartridges, side by side, each including at least one of an image bearing member on which a latent image is to be formed and developing means for developing with a developer the latent image formed on the image bearing member, wherein said first openable member located at the open position is located below said movable member located at the outward position, and wherein an outermost end of said movable member located at the outward position is vertically aligned with or located inside an outermost end of said first openable member located at the open position.

2. An apparatus according to claim 1, wherein said movable member is linearly movable in a direction perpendicular to a longitudinal direction of the image bearing member or the developing means of the cartridge supported by said movable member.

3. An apparatus according to claim 1, wherein said movable member supports the plurality of cartridges so that the cartridges can be successively demounted from a most downstream cartridge with respect to a movement direction during movement of said movable member from the set position to the outward position, and wherein when said movable member is located at the outward position and said second openable member is located at the open position, all the plurality of cartridges are demountable.

4. An apparatus according to claim 1, wherein said movable member is horizontally movable, and wherein at the outward position, said movable member supports the cartridges so as to be demountable right above and supports the cartridges by moving the cartridges right below.

5. An apparatus according to claim 1, further comprising a stacking member, partly projecting from a position vertically aligned with the closed position of said first openable member toward an outside of said main assembly with respect to a direction in which said movable member is movable from the set position to the outward position, for stacking the recording material, and wherein said first openable member and said second openable member are configured so that said first openable member does not interfere with said stacking member when said first openable member is located at the open position.

6. An apparatus according to claim 1, further comprising a stacking member for stacking the recording material, wherein said stacking member is configured so as to be retractable to a position vertically aligned with a position of the outermost end of said first openable member located at the closed position with respect to the direction in which said movable member is movable from the set position to the outward position or is configured to be located inside the position of the outermost end of said first openable member.

7. An image forming apparatus for forming an image on a recording material, comprising:

a photosensitive drum;

a scanner unit for scanning and exposing said photosensitive drum;

an opening provided to a main assembly of said image forming apparatus;

an openable member movable between a closed position in which said opening is closed and an open position in which the first portion of said opening is opened;

a movable member, movable between a set position inside the main assembly and an outward position in which said movable member having passed through said opening is located at an outermost position in a movable range of said movable member, capable of supporting a plurality of cartridges, side by side, each including at least one of a photosensitive drum on which a latent image is to be formed and developing means for developing with a developer the latent image formed on the photosensitive drum; and a vertical wall portion, provided close to an upper portion of said openable member at the closed position of said openable member, for protecting said scanner unit, wherein said openable member located at the open position is located below said movable member located at the outward position, and wherein an outermost end of said movable member located at the outward position is vertically aligned with or located inside an outermost end of said openable member located at the open position.

8. An image forming apparatus for forming an image on a recording material, comprising:

an opening provided to a main assembly of said image forming apparatus;

an openable member movable between a closed position in which said opening is closed and an open position in which said opening is opened;

a movable member, movable between a set position inside the main assembly and an outward position in which said movable member having passed through said opening is located at an outermost position in a movable range of said movable member, capable of supporting a plurality of cartridges, side by side, each including at least one of an image bearing member on which a latent image is to be formed and developing means for developing with a developer the latent image formed on the image bearing member, wherein said openable member located at the open position is located below said movable member located at the outward position, and wherein an outermost end of said movable member located at the outward position is vertically aligned with or located inside an outermost end of said openable member located at the open position.

* * * * *